United States Patent [19]

Bergdolt

[11] 4,314,684

[45] Feb. 9, 1982

[54] SANITARY GLASS HOLDER

[76] Inventor: Henry F. Bergdolt, 1200 Watergate Ct., Raleigh, N.C. 27609

[21] Appl. No.: 75,101

[22] Filed: Sep. 13, 1979

[51] Int. Cl.[3] ..... A47G 23/02

[52] U.S. Cl. ..... 248/146; 248/346.1

[58] Field of Search ..... 248/146, 150, 149, 152, 248/346.1, 311.3, 346; 211/71

[56] References Cited

U.S. PATENT DOCUMENTS

| | | | |
|---|---|---|---|
| 1,318,428 | 10/1919 | Young | 248/311.3 X |
| 2,092,660 | 9/1937 | Uttley | 248/311.3 X |
| 3,181,701 | 5/1965 | Cole | 248/311.3 X |
| 3,214,031 | 10/1965 | McCauley | 211/71 |
| 3,294,352 | 12/1966 | Leonard | 211/60 R X |
| 3,393,892 | 7/1968 | Buck | 248/346.1 |
| 3,538,866 | 11/1970 | Gaines | 248/146 X |

*Primary Examiner*—J. Franklin Foss
*Attorney, Agent, or Firm*—Mills and Coats

[57] ABSTRACT

The present invention relates to a sanitary glass holder for supporting a glass in an upside down position and comprises an annular base with a plurality of generally equally spaced legs extending inwardly from said base towards the center thereof. Each leg includes a concave upper support edge just inwardly of the annular base for receiving the lip of an upside down positioned glass. Still inwardly of the concave support surface, each leg extends upwardly and joins together with the other legs thereat to form a knock off protector such that when the glass is supported about the glass holder of the present invention, the knock off protector extends generally upwardly into the glass.

6 Claims, 2 Drawing Figures

SANITARY GLASS HOLDER

The present invention relates to support devices, and more particularly to a device for supporting a glass in an upside down posture where air can readily reach the interior thereof and wherein the glass can be maintained in a clean and sanitary condition.

BACKGROUND OF INVENTION

Drinking glasses are commonly provided in the bathrooms of homes for drinking and mouth rinsing purposes. In providing drinking glasses in bathrooms and such other places, it is always a concern to maintain the glass or glasses in a clean and sanitary condition. Often the glass is left right side up, and obviously this is not the best position from a sanitary consideration.

In some cases the glass is maintained clean by inverting the glass and supporting the same in the inverted position about a surface or counter top. In such an upside down orientation, air cannot reach the interior of the glass, and accordingly the interior of the glass fogs up. This too is undesirable.

SUMMARY OF INVENTION

The present invention entails a glass holder that is adapted to be used in a bathroom or like place and which is designed to support a glass in an upside down posture but yet provide interior access to the glass that allows air to freely circulate into and through the interior of the glass.

In particular, the sanitary glass holder of the present invention comprises an annular base support structure having a plurality of legs generally equally spaced therearound and extending inwardly towards the center of the base structure. Each leg forms a relatively thin vertical wall structure and includes a concave upper edge surface just interiorly of the annular support ring for receiving the lip of a glass supported thereon in an upside down posture. Each leg continues to extend inwardly from the concave lip support structure where the plurality of legs join together and extend upwardly into the glass to form a knock off protector.

It is, therefore, an object of the present invention to provide a sanitary glass holder that will support a glass or other type of drinking container in an upside down position and which will further allow air to freely reach the interior thereof and to circulate therethrough.

A further object of the present invention is to provide a glass holder of the character described above that is simple, easy to manufacture, and durable and relatively inexpensive.

Another object of the present invention resides in the provision of a glass holder of the character described above that is designed to support and maintain the glass in a stable position, and which is further provided with means to prevent inadvertently knocking the glass from the holder.

In addition, it is an object of the present invention to provide a sanitary glass holder of the character described above which is adapted to be supported about a counter top or flat surface, and which it can be adapted to be mounted to a vertical wall.

Yet another object of the present invention resides in the provision of a sanitary glass holder of the character described above which can be modified to include at least one article holder for holding articles such as toothbrushes or razors.

Still a further object of the present invention resides in the provision of a sanitary glass holder of the basic character described above which is adapted to receive and support various size and shapes of glasses and drinking containers.

Other objects and advantages of the present invention will become apparent from a study of the following description and the accompanying drawings which are merely illustrative of the present invention.

DESCRIPTION OF PREFERRED EMBODIMENT

Figure 1:
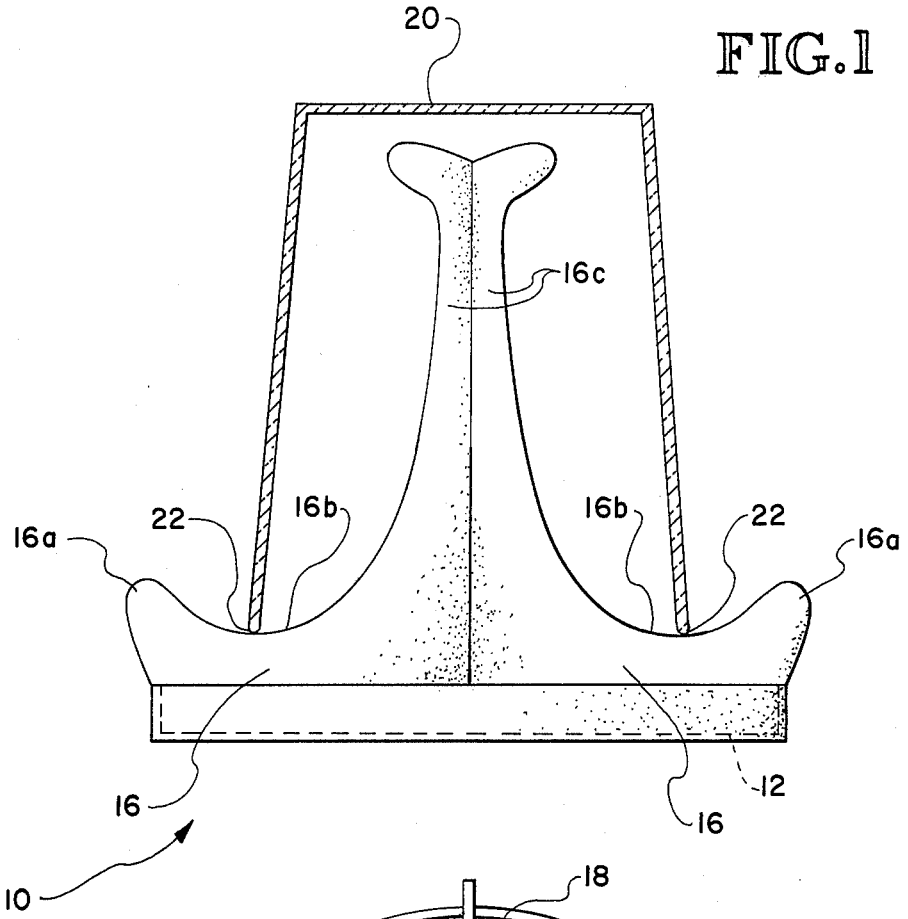
FIG. 1 is a side elevational view of the glass holder of the present invention.
Figure 2:
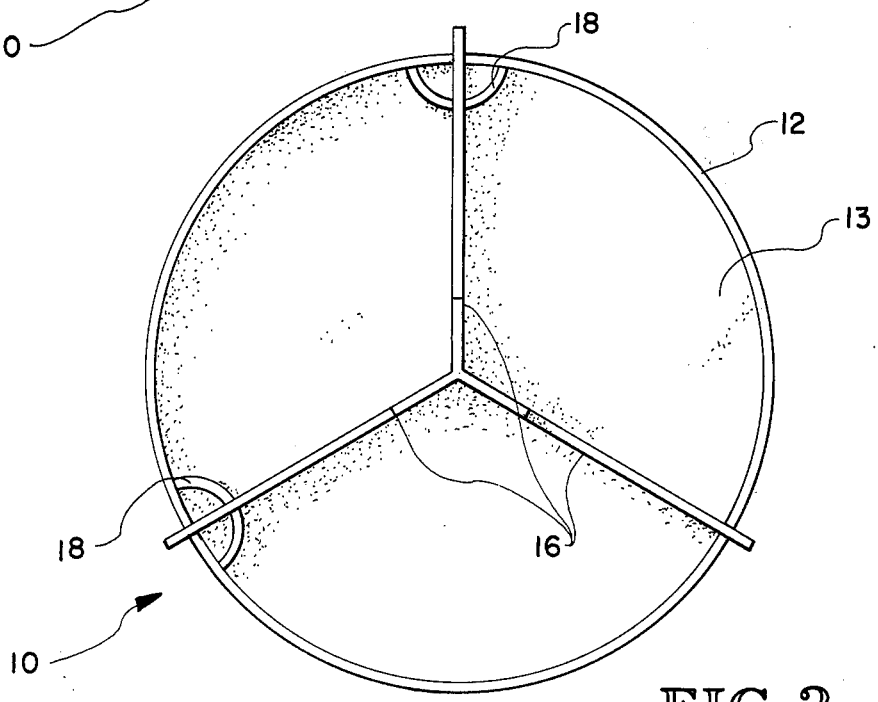
FIG. 2 is a plan view of the glass holder of the present invention.

With further reference to the drawings, the sanitary glass holder of the present invention is shown therein and indicated generally by the numeral 10.

Glass holder 10 comprises an annular ring type base support 12 that defines an area therein that may further include a bottom 13 for receiving water droplets. Equally spaced around the circular area defined by annular support 12 is a series of legs 16. Legs 16 are in the form of a relatively thin vertical wall and extend from the annular support 12 inwardly towards the center thereof, where in the preferred embodiment, the legs 16 join together.

In the case of the preferred embodiment disclosed herein, glass holder 10 comprises three legs 16 that are equally spaced approximately 120 degrees apart. About the exterior of each leg generally overlying the annular support 12, each leg is provided with a raised or elevated portion 16*a*. Just inwardly of the raised or elevated portion 16*a* is a concave support edge 16*b* that defines a support surface for receiving lip 22 of supported glass 20.

From the concave upper edge support surface 16*b*, the elevation of each leg increases rapidly towards the center of the annular support 12 to form a knock off protector portion 16*c*.

As seen in FIG. 1, a glass 20 is supported such that its drinking lip 22 engages the concave upper edge portion 16*b* of the respective legs. The knock off protectors 16*c* extend upwardly into the interior of the glass 20 and are actually joined together about the central portion of annular support 12.

To provide additional utility to the glass holder 10 of the present invention, one or more article holders 18 may be appropriately provided. In the case of the embodiment disclosed, the article holders extend from an exterior portion of a respective leg 16 to the inside of the annular support ring 12. Thus it is seen that the respective article holders 18 define openings for receiving articles such as toothbrushes, razors or the like.

The sanitary glass holder 10 of the present invention can be constructed of any suitable material and it is contemplated that it could be formed entirely of plastic.

It is thusly appreciated that air can move under the lip 22 of the glass 20 between the respective legs 16 and can easily reach the interior of the glass and circulate therethrough. This will prevent the glass from fogging up about the interior thereof. Yet the glass holder 10 of the present invention enables the glass to be maintained in a sanitary upside down position.

From the foregoing description and specification, it is seen that the glass holder 10 of the present invention enables the glass or drinking container to be maintained in a clean and sanitary position but yet allows air to freely reach and move through the interior of the supported glass. In addition, it is obvious that the present invention is simple, reliable, and can easily be manufactured and produced at a cost that would be relatively inexpensive.

The terms "upper", "lower", "forward", "rearward", etc., have been used herein merely for the convenience of the foregoing specification and in the appended Claims to describe the glass holder and its parts as oriented in the drawings. It is to be understood, however, that these terms are in no way limiting to the invention since the glass holder may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A sanitary glass holder for supporting a glass in an upside down position where air can freely reach the interior thereof, comprising: a base structure extending around a defined area; at least three support legs having upper suport edges and extending inwardly in a radial fashion from said base structure generally towards a central area of said defined area, said support legs being generally equally spaced apart about said base structure and form a resting and support surface about the upper edges thereof for supporting the lip of a glass disposed thereon in an upside down orientation; said support legs, interiorly of the resting and support surface, extending upwardly to form an integral elevated knock off protector that generally prohibits the glass from being inadvertently knocked from the glass holder; and said base structure and said legs cooperating to define an open area between the lip of a glass supported in an upside down orientation thereon and said base structure for allowing air to circulate into and through the interior of said upside down supported glass.

2. The glass holder of claim 1 wherein said knock off protector structure forms an interior portion of each leg, and wherein there is provided a raised exterior portion that lies generally over the base structure, and wherein between said raised exterior portion and said interior knock off protector each leg is provided with a generally concave seat portion that supports the lip of the upside down glass.

3. The sanitary glass holder of claim 2 wherein the same comprises three support legs equally spaced about said base support structure.

4. The sanitary glass holder of claim 3 wherein said base support structure comprises a circular ring type structure and wherein each leg extends from the ring type structure inwardly to the center thereof where the respective legs join and extend upwardly to form said knock off protector.

5. The glass holder of claim 4 wherein each leg includes a solid panel structure that extends from the center of said ring support structure outwardly thereto.

6. The glass holder of claim 5 comprising at least one article holder extending from an exterior portion of a respective leg to an inside portion of the ring structure forming said base support.

* * * * *